US006495495B1

(12) United States Patent
Alger et al.

(10) Patent No.: US 6,495,495 B1
(45) Date of Patent: Dec. 17, 2002

(54) FILTERABILITY IMPROVER

(75) Inventors: Robert W. Alger, Mickleover; Michael R. P. Kohut, Belper; Stephen J. Nolan, Little Eaton, all of (DE)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/634,827

(22) Filed: Aug. 9, 2000

Related U.S. Application Data

(60) Provisional application No. 60/150,041, filed on Aug. 20, 1999, and provisional application No. 60/164,426, filed on Nov. 9, 1999.

(51) Int. Cl.[7] ..... C10M 161/00
(52) U.S. Cl. ..... 508/475
(58) Field of Search ..... 508/475

(56) References Cited

U.S. PATENT DOCUMENTS

| | | | | | |
|---|---|---|---|---|---|
| 2,901,458 | A | | 8/1959 | Banes et al. | 260/45.5 |
| 3,010,899 | A | | 11/1961 | Boyer | 252/29 |
| 3,087,894 | A | | 4/1963 | McKegney | 252/56 |
| 3,250,599 | A | | 5/1966 | Kirk et al. | 44/62 |
| 3,250,714 | A | | 5/1966 | Ilnyckyl et al. | 252/56 |
| 3,567,639 | A | | 3/1971 | Aaron et al. | 252/56 |
| 3,832,150 | A | | 8/1974 | Feldman | 44/62 |
| 3,947,368 | A | | 3/1976 | Sweeney | 252/56 |
| 3,981,850 | A | | 9/1976 | Wisotsky et al. | 526/227 |
| 4,087,255 | A | | 5/1978 | Wisotsky et al. | 44/62 |
| 4,556,499 | A | | 12/1985 | Heier et al. | 252/51.5 A |
| 4,746,327 | A | | 5/1988 | Smyser | 44/62 |
| 4,772,673 | A | | 9/1988 | Hobes et al. | 526/316 |
| 5,554,200 | A | | 9/1996 | Brod et al. | 44/393 |
| 5,716,915 | A | | 2/1998 | Brown et al. | 508/467 |
| 5,718,734 | A | | 2/1998 | Davies | 44/393 |
| 5,807,949 | A | * | 9/1998 | Rossi et al. | 585/10 |
| 5,906,663 | A | | 5/1999 | Brown et al. | 44/393 |
| 5,998,530 | A | * | 12/1999 | Krull et al. | 208/19 |
| 6,010,989 | A | | 1/2000 | Krull et al. | 508/475 |
| 6,143,044 | A | * | 11/2000 | Davies et al. | 44/393 |

FOREIGN PATENT DOCUMENTS

| | | | |
|---|---|---|---|
| CA | 1 271 895 | | 7/1990 |
| DE | 11 47 799 | B1 | 4/1963 |
| DE | 19 14 756 | B2 | 11/1969 |
| DE | 154 869 | | 4/1982 |
| DE | 203 564 | A | 10/1983 |
| EP | 0 007 590 | | 2/1981 |
| EP | 0 045 342 | | 2/1982 |
| EP | 111883 | B1 | 8/1985 |
| EP | 203 554 | B1 | 10/1988 |
| EP | 0 320 766 | A | 6/1989 |
| EP | 184083 | B1 | 10/1989 |
| JP | 358129096 | A | 1/1983 |

OTHER PUBLICATIONS

Abstract for DD 154 869, Germany.
Abstract for EP 0 045 342, Europe.
Abstract for DD 203 564A, Germany.
Abstract for EP 0 007 590, Europe.
Abstract for EP 320 766 A, Europe.
Abstract for J5 8129 096 A, Japan.

* cited by examiner

*Primary Examiner*—Jacqueline V. Howard
(74) *Attorney, Agent, or Firm*—Teresan W. Gilbert; Michael F. Esposito

(57) ABSTRACT

The present invention relates to an additive comprising a blend of an alkyl ester copolymer, preferably an ethylene-vinyl acetate copolymer, and naphthenic oil. The invention further relates to the use of such alkyl ester copolymers for improving the flow properties of mineral oils. Most preferably, the additive is employed in manual transmission oils, axle factory fill oils, and extended drain oils, when used in conjunction with driveline oil filtration. The additive of the present invention prevents filter blockage of such a filter due to wax formation.

17 Claims, 12 Drawing Sheets

An Example of a Plot of CETOP Filterability Tests on "Blocking" and Non-Blocking" Blends CETOP Filterability Results for Total 85W/140 Blends

FIGURE 4 - CETOP Filterability Data

| Sample: | TOTAL BS | Blend A | Blend B | Blend C | | | | | | |
|---|---|---|---|---|---|---|---|---|---|---|
| TOTAL 150 BS | 100.00% | 91.50% | 91.00% | 91.00% | | | | | | |
| A2000 | | 8.50% | 8.50% | 8.50% | | | | | | |
| Plexol 156 | | | 0.50% | 0.50% | | | | | | |
| OS109513 | | | | 400 ppm | | | | | | |

| Sample | TOTAL BS | Blend A | Blend A | Blend B | Blend B | Blend C | Blend C | Blend C | Blend C | Blend C |
|---|---|---|---|---|---|---|---|---|---|---|
| Age | 1 day(s) | 3 day(s) | 115 day(s) | 2 day(s) | 115 day(s) | 1 day(s) | 2 day(s) | 8 day(s) | 17 day(s) | 115 day(s) |
| Run | A1NF | A1NF r1 | A1NF | A1NF | A1NF | A1NF | A1NF | A1NF | A1NF | A1NF |
| Test Date: | ############ | ############ | ############ | ############ | ############ | ############ | ############ | ############ | ############ | ############ |
| Density: | 0.893 | 0.893 | 0.893 | 0.893 | 0.893 | 0.893 | 0.893 | 0.893 | 0.893 | 0.893 |
| Operator: | SJN | SJN | SJN | SJN | SJN | SJN | SJN | SJN | SJN | SJN |

| Sample | TOTAL BS | Blend A | Blend A | Blend B | Blend B | Blend C | Blend C | Blend C | Blend C | Blend C |
|---|---|---|---|---|---|---|---|---|---|---|
| Mass t=240 ml | Blocked | Blocked | Blocked | 205.17 | 197.60 | 216.28 | 204.44 | 179.31 | 175.75 | 191.05 |
| CETOP Stage 1 | Blocked | Blocked | Blocked | 91.56% | 88.03% | 96.75% | 91.22% | 79.50% | 77.84% | 84.98% |
| CETOP Stage 2 | Blocked | Blocked | Blocked | 82.32% | 71.52% | 91.25% | 81.32% | 60.91% | 58.60% | 73.76% |
| T300 ml | N/A | N/A | N/A | 4556 | 2911 | 3588 | 4332 | 6282 | 7206 | 4179 |
| $R^2$ Linearity | 0.8432 | 0.7996 | 0.8551 | 0.9990 | 0.9262 | 0.9997 | 0.9988 | 0.9945 | 0.9935 | 0.9981 |

| Volume | Time (s) | Time (s) | Time (s) | Time (s) | Time (s) | Time (s) | Time (s) | Time (s) | Time (s) | Time (s) |
|---|---|---|---|---|---|---|---|---|---|---|
| 0 ml | 0 | 0 | 0 | 0 | 0 | 0 | 0 | 0 | 0 | 0 |
| 10 ml | 200 | 202 | 116 | 146 | 75 | 113 | 135 | 127 | 140 | 99 |
| 20 ml | 445 | 517 | 331 | 278 | 156 | 227 | 260 | 266 | 294 | 206 |
| 30 ml | 747 | 1081 | 808 | 413 | 235 | 342 | 387 | 415 | 459 | 318 |
| 40 ml | 1148 | 2380 | 2550 | 540 | 316 | 456 | 515 | 573 | 635 | 435 |
| 50 ml | 1698 | 6191 | 0 | 686 | 398 | 570 | 646 | 738 | 820 | 556 |
| 60 ml | 2468 | 0 | 0 | 826 | 480 | 685 | 777 | 909 | 1013 | 680 |
| 70 ml | 3626 | 0 | 0 | 967 | 564 | 800 | 910 | 1085 | 1213 | 807 |
| 80 ml | 5433 | 0 | 0 | 1109 | 649 | 916 | 1045 | 1264 | 1419 | 936 |
| 90 ml | 8393 | 0 | 0 | 1252 | 736 | 1031 | 1181 | 1452 | 1632 | 1069 |
| 100 ml | 0 | 0 | 0 | 1397 | 823 | 1146 | 1318 | 1643 | 1850 | 1202 |
| 110 ml | 0 | 0 | 0 | 1544 | 912 | 1264 | 1457 | 1838 | 2074 | 1338 |
| 120 ml | 0 | 0 | 0 | 1691 | 1002 | 1381 | 1597 | 2039 | 2304 | 1476 |
| 130 ml | 0 | 0 | 0 | 1841 | 1095 | 1499 | 1738 | 2244 | 2538 | 1616 |
| 140 ml | 0 | 0 | 0 | 1991 | 1188 | 1617 | 1881 | 2451 | 2777 | 1757 |
| 150 ml | 0 | 0 | 0 | 2142 | 1283 | 1735 | 2025 | 2661 | 3020 | 1898 |
| 160 ml | 0 | 0 | 0 | 2294 | 1379 | 1854 | 2170 | 2874 | 3268 | 2042 |
| 170 ml | 0 | 0 | 0 | 2448 | 1478 | 1973 | 2316 | 3094 | 3521 | 2187 |
| 180 ml | 0 | 0 | 0 | 2602 | 1578 | 2094 | 2463 | 3317 | 3778 | 2333 |
| 190 ml | 0 | 0 | 0 | 2759 | 1679 | 2214 | 2612 | 3544 | 4040 | 2482 |
| 200 ml | 0 | 0 | 0 | 2916 | 1782 | 2336 | 2761 | 3774 | 4305 | 2630 |
| 210 ml | 0 | 0 | 0 | 3075 | 1887 | 2458 | 2912 | 4008 | 4575 | 2781 |
| 220 ml | 0 | 0 | 0 | 3234 | 1994 | 2580 | 3064 | 4245 | 4850 | 2932 |
| 230 ml | 0 | 0 | 0 | 3395 | 2102 | 2703 | 3217 | 4487 | 5130 | 3085 |
| 240 ml | 0 | 0 | 0 | 3557 | 2213 | 2827 | 3372 | 4731 | 5413 | 3238 |
| 250 ml | 0 | 0 | 0 | 3721 | 2324 | 2952 | 3528 | 4981 | 5702 | 3393 |
| 260 ml | 0 | 0 | 0 | 3885 | 2438 | 3078 | 3687 | 5232 | 5996 | 3548 |
| 270 ml | 0 | 0 | 0 | 4051 | 2554 | 3205 | 3846 | 5488 | 6292 | 3705 |
| 280 ml | 0 | 0 | 0 | 4216 | 2671 | 3331 | 4006 | 5750 | 6592 | 3862 |
| 290 ml | 0 | 0 | 0 | 4387 | 2790 | 3460 | 4168 | 6014 | 6897 | 4019 |
| 300 ml | 0 | 0 | 0 | 4556 | 2911 | 3588 | 4332 | 6282 | 7206 | 4179 |

CETOP Filterability Results for Blend G

FIGURE 12 - CETOP Filterability Results

| Blend Type | Blend H (without additive) | Blend H (with additive) | Blend I (without additive) | Blend I (with additive) | Blend J (without additive) | Blend J (with additive) | Blend K (without additive) | Blend K (with additive) | Blend L (without additive) | Blend L (with additive) | Blend M (without additive) | Blend M (with additive) |
|---|---|---|---|---|---|---|---|---|---|---|---|---|
| Volume Filtered | Time (s) | Time (s) | Time (s) | Time (s) | Time (s) | Time (s) | Time (s) | Time (s) | Time (s) | Time (s) | Time (s) | Time (s) |
| 0 ml | 0 | 0 | 0 | 0 | 0 | 0 | 0 | 0 | 0 | 0 | 0 | 0 |
| 10 ml | 22 | 21 | 19 | 19 | 20 | 20 | 16 | 17 | 18 | 16 | 18 | 15 |
| 20 ml | 44 | 42 | 37 | 37 | 40 | 39 | 32 | 32 | 36 | 31 | 35 | 29 |
| 30 ml | 67 | 63 | 55 | 56 | 59 | 59 | 48 | 48 | 55 | 46 | 53 | 44 |
| 40 ml | 91 | 84 | 73 | 74 | 79 | 78 | 64 | 63 | 75 | 61 | 70 | 58 |
| 50 ml | 115 | 105 | 92 | 92 | 99 | 98 | 81 | 79 | 95 | 76 | 88 | 73 |
| 60 ml | 140 | 126 | 111 | 111 | 119 | 118 | 98 | 94 | 117 | 91 | 106 | 88 |
| 70 ml | 165 | 147 | 130 | 130 | 139 | 137 | 116 | 110 | 139 | 107 | 124 | 103 |
| 80 ml | 190 | 169 | 149 | 148 | 159 | 157 | 133 | 126 | 162 | 122 | 142 | 117 |
| 90 ml | 216 | 190 | 169 | 167 | 179 | 177 | 152 | 142 | 186 | 137 | 161 | 132 |
| 100 ml | 242 | 211 | 188 | 187 | 199 | 196 | 170 | 157 | 211 | 152 | 179 | 147 |
| 110 ml | 269 | 233 | 207 | 206 | 220 | 216 | 189 | 173 | 236 | 168 | 198 | 162 |
| 120 ml | 296 | 254 | 227 | 225 | 240 | 236 | 208 | 189 | 262 | 183 | 216 | 177 |
| 130 ml | 323 | 276 | 247 | 244 | 261 | 256 | 228 | 205 | 289 | 198 | 235 | 192 |
| 140 ml | 351 | 297 | 266 | 263 | 281 | 276 | 248 | 221 | 317 | 214 | 253 | 207 |
| 150 ml | 379 | 318 | 286 | 282 | 302 | 296 | 268 | 237 | 346 | 229 | 272 | 223 |
| 160 ml | 407 | 340 | 306 | 301 | 323 | 316 | 289 | 253 | 375 | 245 | 290 | 238 |
| 170 ml | 437 | 361 | 326 | 320 | 344 | 336 | 310 | 270 | 406 | 260 | 309 | 253 |
| 180 ml | 466 | 383 | 346 | 340 | 365 | 356 | 331 | 286 | 438 | 276 | 328 | 268 |
| 190 ml | 496 | 405 | 366 | 360 | 386 | 376 | 354 | 302 | 470 | 291 | 347 | 283 |
| 200 ml | 526 | 427 | 386 | 381 | 407 | 396 | 376 | 319 | 504 | 307 | 366 | 299 |
| 210 ml | 557 | 449 | 407 | 402 | 429 | 417 | 399 | 335 | 539 | 322 | 385 | 314 |
| 220 ml | 588 | 471 | 427 | 422 | 450 | 437 | 423 | 352 | 575 | 338 | 404 | 330 |
| 230 ml | 619 | 493 | 448 | 442 | 472 | 457 | 448 | 369 | 612 | 354 | 424 | 346 |
| 240 ml | 651 | 515 | 469 | 462 | 493 | 478 | 472 | 385 | 651 | 369 | 443 | 362 |
| 250 ml | 683 | 537 | 490 | 483 | 515 | 499 | 497 | 402 | 691 | 385 | 462 | 378 |
| 260 ml | 716 | 560 | 511 | 503 | 537 | 519 | 523 | 419 | 732 | 400 | 482 | 393 |
| 270 ml | 748 | 582 | 532 | 523 | 558 | 539 | 549 | 435 | 774 | 416 | 501 | 409 |
| 280 ml | 782 | 605 | 553 | 543 | 581 | 560 | 575 | 452 | 818 | 432 | 520 | 425 |
| 290 ml | 816 | 627 | 574 | 563 | 602 | 581 | 602 | 468 | 864 | 447 | 539 | 440 |
| 300 ml | 850 | 650 | 595 | 584 | 624 | 601 | 630 | 485 | 911 | 463 | 559 | 456 |
| Mass 240 | 197.90 | 222.49 | 213.10 | 214.74 | 218.70 | 222.81 | 193.60 | 220.30 | 175.60 | 222.40 | 216.00 | 219.00 |
| CETOP Stage1 | 86.45% | 97.71% | 93.41% | 94.16% | 95.97% | 97.85% | 84.48% | 96.70% | 76.24% | 97.66% | 94.73% | 96.11% |
| CETOP Stage2 | 71.76% | 94.17% | 87.32% | 89.90% | 91.01% | 95.12% | 63.98% | 93.37% | 47.30% | 96.15% | 90.67% | 92.36% |

FILTERABILITY IMPROVER

This application claims priority from Provisional Application No. 60/150,041 filed Aug. 20, 1999, and Provisional Application No. 60/164,426 filed Nov. 9, 1999.

TECHNICAL FIELD

The present invention relates to a filterability improver comprising a blend of an ethylene-vinyl acetate copolymer and naphthenic oil, useful in eliminating mineral oil base fluid effects having a significant impact on filterability performance of an oil.

BACKGROUND OF THE INVENTION

Mineral oil products used in the transportation industry, for example, in engine oils, contain various amounts of dissolved long-chain paraffins (waxes), depending on their origin. At low temperatures, these paraffins precipitate as platelet-shaped crystals, sometimes with the inclusion of oil. This considerably impairs the flow properties of the mineral oil. Deposits of solids occur, which often lead to problems in the use of such mineral oil products.

In the cold season, for example, blockages occur in the filters of diesel engines which prevent reliable metering of the fuels and ultimately can even result in an interruption of the supply of fuel. The ability of mineral oil to flow is impaired in winter by the precipitation of paraffin crystals.

It is known that the undesirable crystal growth can be suppressed by suitable additives, so that the tendency of the viscosity of the oils to increase is minimized. Such additives, which are known pour-point depressants or agents which improve flow, change the size and shape of the wax crystals and, in this way, counteract increases in the viscosity of the oils.

Typical agents for improving the flow of mineral oils are copolymers of ethylene with carboxylic acid esters of vinyl alcohol. German Patent No. DE 11 47 799 B1, for example, sets forth oil-soluble copolymers of ethylene and vinyl acetate, having molecular masses between about 1,000 and about 3,000 g/mol, that are added to petroleum distillate propellants or fuels. Copolymers that contain about 60% to 99% by weight of ethylene and about 1% to 40% by weight of vinyl acetate are preferred. They are particularly effective if they have been prepared by free-radical polymerization in an inert solvent at temperatures of about 70° C. to about 130° C. under pressures of 35 to 2,100 atmospheres gauge, as set forth in German Patent No. DE 19 14 756 B2.

Other polymers employed as agents which improve flow contain, for example, 1-hexene, as set forth in EP 184,083 B1, or diisobutylene, as set forth in EP 203,554 B1, in addition to ethylene and vinyl acetate. Copolymers of ethylene, alkenecarboxylic acid esters, vinyl esters and/or vinyl ketones are also used as pour-point depressants and for improving the flow properties of crude oils and middle distillates as disclosed in EP 111,883 B1.

Additives that have a wide range of application, i.e. that effectively suppress precipitation of paraffins from mineral oils and mineral oil fractions of differing origin, have since become available. Nevertheless, there are cases in which they prove to be of little or even no value, either because they contribute little toward increasing the flow properties at low temperatures, they impair the filterability of mineral oil distillates above the cloud point, and/or they can be handled only unsatisfactorily.

There is, therefore, a need for novel additives for improving the flow properties of petroleums or petroleum fractions in which the additives of the prior art have little or even no effect. There is also a need of novel additives that provide adequate filterability of petroleum distillates above the cloud point, and that are usable without problems.

SUMMARY OF THE INVENTION

The invention relates to an additive comprising a blend of an alkyl ester copolymer, preferably an ethylene-vinyl acetate copolymer, and naphthenic oil. The invention further relates to the use of such alkyl ester copolymers for improving the flow properties of mineral oils. The invention further relates to the use of the additive comprising a blend of an alkyl ester polymer in a fluid filter system. In particular, the novel additive is used to improve filterability of heavy base oils containing wax materials. Further, the novel additive is used to promote extended drain of gear oil lubricants in connection with 5 $\mu$m filtration systems.

According to the present invention, the additive can be employed for improving flow both in crude oils and in the products of further processing obtained from the crude oil by distillation. However, its use in mineral oil distillates is preferred. Most preferably, the additive according to the present invention is employed in manual transmission oils, axle factory fill oils, and extended drain oils when used in conjunction with driveline oil filtration. Such an example is used in a fill-for-life gearbox system utilizing a 5 $\mu$m filtration system in the sump. The filter is used to extend the life of the gearbox by removing any foreign matter of significant size from the lubricant and by minimizing the potential for abrasive corrosion that has a catalytic effect on wear leading to gear failure. The additive of the present invention prevents filter blockage of such a filter due to wax formation.

BRIEF DESCRIPTION OF THE DRAWINGS

FIG. 4 shows the effect of ageing on blends.

FIG. 12 shows CETOP Filterability data for Blends H–M, with and without additive.

DETAILED DESCRIPTION OF THE PREFERRED EMBODIMENTS

Figure 1:
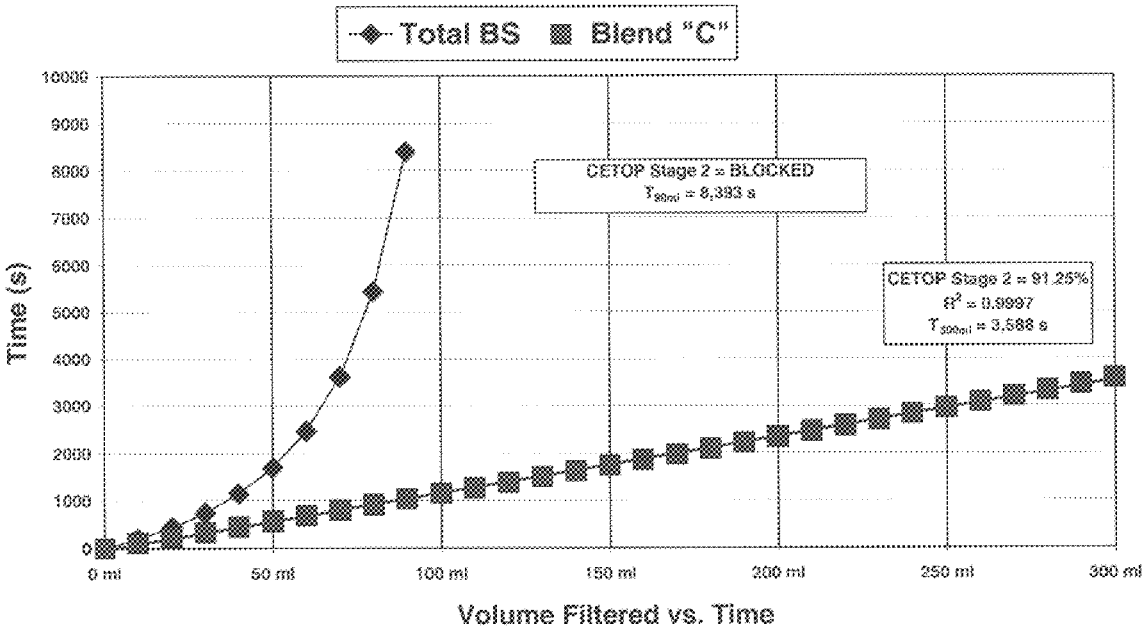
FIG. 1 is an example of a plot of CETOP Filterability Tests on "blocking" and "non-blocking" blends.

The filterability improver according to the present invention is a blend comprising from about 30% to about 70% of a copolymer of an alkyl ester and from about 70% to about 30% naphthenic oil, preferably about 50% of an alkyl ester copolymer and about 50% naphthenic oil, based upon the total weight of the blend.

In another preferred embodiment, the filterability improver according to the present invention comprises about 50% of an ethylene-vinyl acetate copolymer and about 50% naphthenic oil, based upon the total weight of the blend.

The ethylene to vinyl acetate ratios of the ethylene-vinyl acetate copolymer useful in the present invention range from about 64.9:35.1 to about 83.2:16.8. This ratio is mole % ethylene:vinyl acetate.

Other polymers useful for the present invention include ethylene-vinyl proprionate copolymers, ethylene-vinyl butyrate copolymers, $C_2$–$C_{12}$ olefin-vinylacetate copolymers, ethylene-$C_4$ olefin-vinyl acetate tertpolymers, ethylene-vinyl acetate-vinyl ether tertpolymers, ethylene-propylene copolymers, ethylene-propylene vinyl acetate tertpolymers, and ethylene-diene-vinyl acetate terpolymers.

The molecular weight of the polymers useful for the present invention ranges from about 2,000 to about 10,000, preferably from about 3,000 to about 4,000, having a branching index from about 4 to about 10, preferably from about 8 to about 9.

One or combinations thereof of these polymers are combined with a naphthenic oil to form a blend, which is the filterability improver of the present invention. The blend contains from about 30% to about 70% of at least one polymer and about 70% to about 30% naphthenic oil, preferably about 50% of at least one polymer with about 50% naphthenic oil, based upon the total weight of the blend.

The filterability additive according to the present invention is useful in gear oil formulation applications where filterability performance is specified. A suitable gear oil formulation example is Total Brightstock-based gear oil formulations SAE 85W/140 grade gear oil that are made using Total Brightstock. The term "Brightstock" as used throughout this specification is a known industry term. It is a generic name for a high viscosity mineral oil. Refineries sell their own Brightstocks that can be used to formulate mineral oil-based blends of moderate to high viscosities, e.g., gear oils, hydraulic oils, semi-fluid greases etc. Brightstocks from different sources, for example, from Shell, Mobil, or Total, experience filter blocking, to differing degrees, due to the very small amounts of wax that are inherent in these oils. A Brightstock from Total is referred to as Total Brightstock or ex-Total.

The treat level of the additive according to the present invention is from about 10 to about 1,000 ppm, preferably about 250 ppm to about 650 ppm, and most preferably about 400 ppm, based upon the total weight of the gear oil formulation plus the additive (filterability improver) of the present invention. The treat level can vary, depending upon the specified filterability target and long-term (ageing) effects of the formulation.

The additive which improves filterability of mineral oil according to the present invention works by modifying the structure of wax particles to reduce blockage of the around 5 $\mu$m pores of a filter membrane used, for, in a fill-in-life gearbox system.

The ability of the additive according to the present invention to improve filterability was evaluated using what is known in the industry as the CETOP Filterability Test. This test is used in the industry to ascertain the filter blocking tendency of a given fluid. It involves Stage 1 or Stage 2 calculations, described below.

$$\text{CETOP Stage 1} = \frac{(V\,[6\times(T_{50}-T_{10})+T_{10})])-10}{240}\times 100$$

CETOP Stage 1 Filterability is given by the ratio, expressed as a percentage, of 240 ml, and the volume of oil actually filtered in the time the 240 ml would have theoretically taken, assuming no plugging of the membrane. The subtraction of 10 ml corrects for the volume which has passed at $T_{10}$. The industry views this calculation as less relevant than CETOP Stage 2 calculations, for several reasons, but probably because it does not span the full test. CETOP Stage 2 calculations are set forth below.

$$\text{CETOP Stage 2}=[2.5\times(T_{50}-T_{10})/(T_{300}-T_{200})]\times 100$$

CETOP Stage 2 Filterability is given by the ratio, expressed as a percentage, of the flow rate through the membrane at the end of the test and the flow rate at the beginning of the test. This is the preferred calculation. The industry views a result of >90% as acceptable; however, the calculation is sensitive to errors in the earliest ($T_{10}$) value and repeatability is poor for very low and high viscosity fluids. The calculation uses only 4 data values; the newest approach uses 30 data values and as such is less sensitive to $T_{10}$ error.

The CETOP Filterability Test was modified to obtain a graphic illustration, as shown in FIGS. 1–5, rather than a calculated percentage value typical of this test. This was done by taking time values for every 10 ml filtered throughout the test, up to and including the 300 ml end point.

A resultant plot that is linear represents a "non-blocking" fluid. A plot that is curved indicates that filter blockage has occurred. The point at which "non-blocking" (acceptable) becomes "blocking" (unacceptable) is taken from the linear regression value (where $R^2$=1.0000 is ideal).

The traditional CETOP Stage 2 calculation provides that values greater than 90% are deemed acceptable (a pass, no blockage) in the industry. This was found to correlate with $R^2$ values of approximately 0.9996 of the modified test. Therefore $R^2$ values greater than 0.9996 are deemed acceptable (a pass, no blockage) in the modified test.

The filterability performance of mineral oil-containing blends can be severely affected by the "age" of the sample, (e.g., the time since the fluid was last heated). To accommodate this, the modified test includes a pretest heating process designed to eliminate any "thermal history." The sample is heated to approximately 70° C. for approximately 4 hours (ideally in an original container), removed from the oven, given a brief shake, then allowed to cool slowly to ambient temperature (approximately 20 hrs) before being tested. This correlates with the conditions a fluid will typically undergo prior to being forced through a filtration unit.

Below are examples of evaluations of base stocks observed using the CETOP Filterability Test with and without the filterability additive according to the present invention.

Specifically, the filterability improver of the present invention was evaluated as a "filterability fix" in a commercially available mineral oil blend. The specific commercially available mineral oil blend evaluated was a (1) Total Brightstock available from Total, referred throughout this specification as ex. Total (identified as blends A, B, C, D, E, F and G), and (2) Ready Blends available from Castrol, referred throughout this specification as ex. Castrol Blends (identified as blends H, I, J, K, L and M).

The modified procedure for CETOP Filterability Test was conducted as follows.

Each blend was filtered using the same conditions as soon as possible after blending or after pre-test heating of each sample, ideally within the next day. All filtration tests were carried out at 1 bar pressure. A new millipore 5 $\mu$m cellulose filter membrane was used for each test.

Each sample was filtered a first time through the membrane. This first pass is called "new filter" (NF). A computer was used to record time values in seconds for every 10 ml filtered.

To correlate with service conditions, if no significant blockage occurred, yet CETOP Stage 2 results were less than 90%, the filtered oil was retested through the same (unchanged) membrane. This repeat pass is called "same filter" (SF), and serves to verify a borderline result. This is only required for borderline circumstances.

Figure 2:
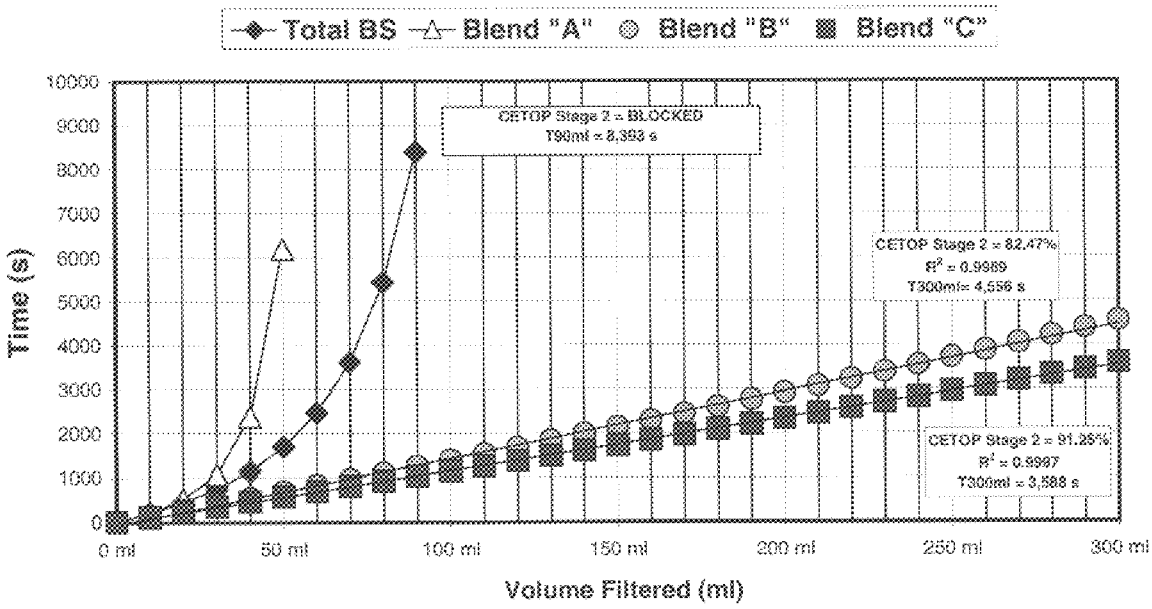
FIG. 2 shows plots of a Total Basestock blend, Blend A, Blend B and Blend C.
Figure 3:
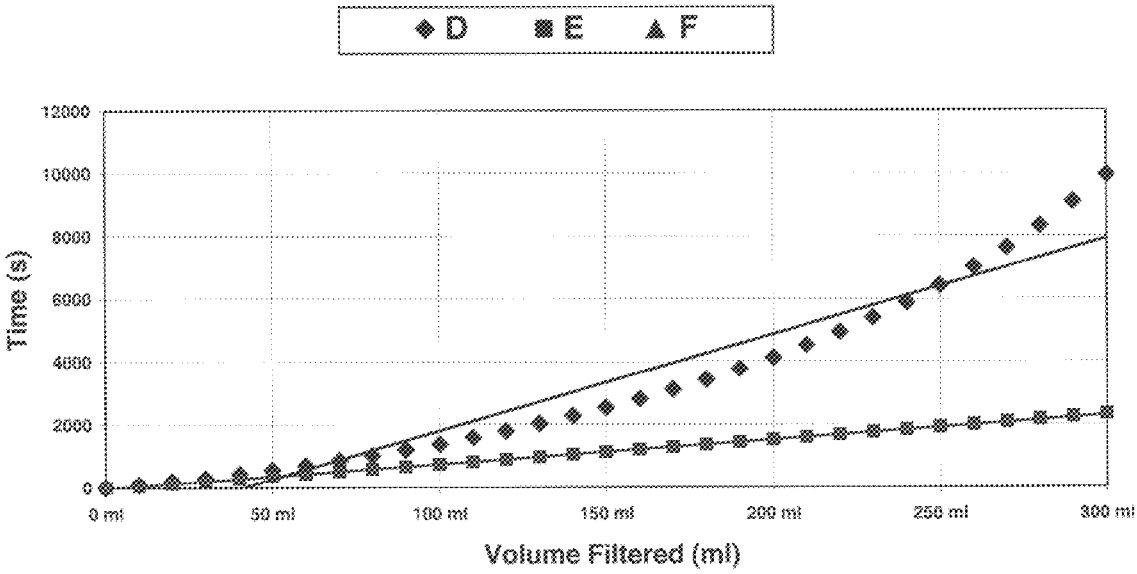
FIG. 3 shows plots of CETOP Filterability Tests on blends D, E and F.
Figure 5:
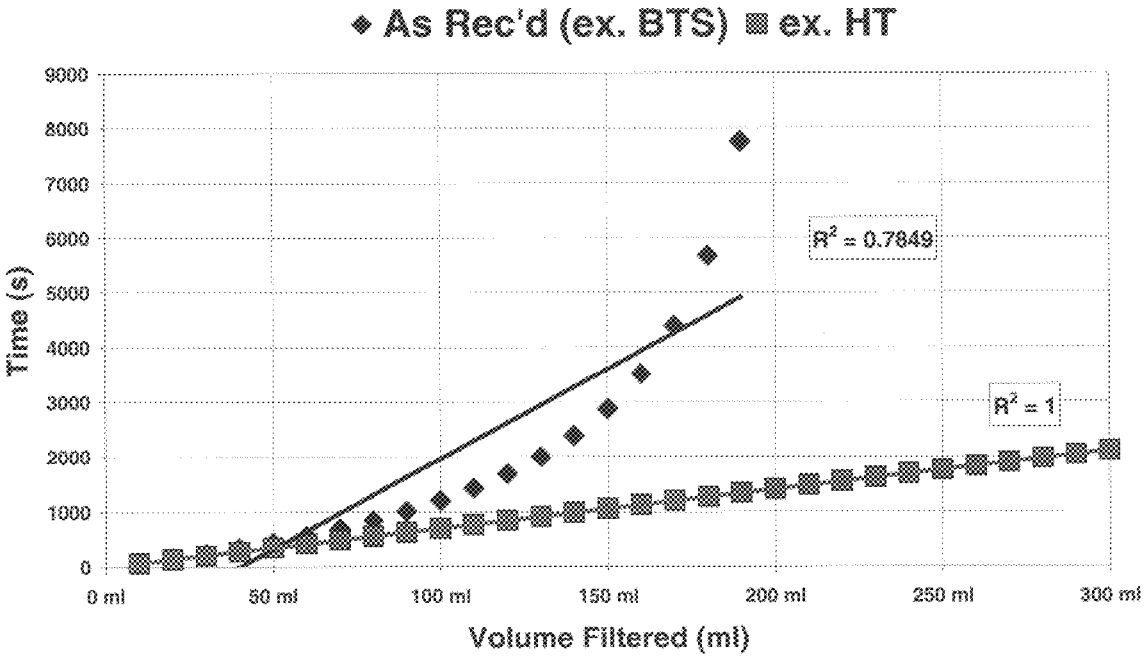
FIG. 5 shows CETOP Filterability results on Blend G.
Figure 6:
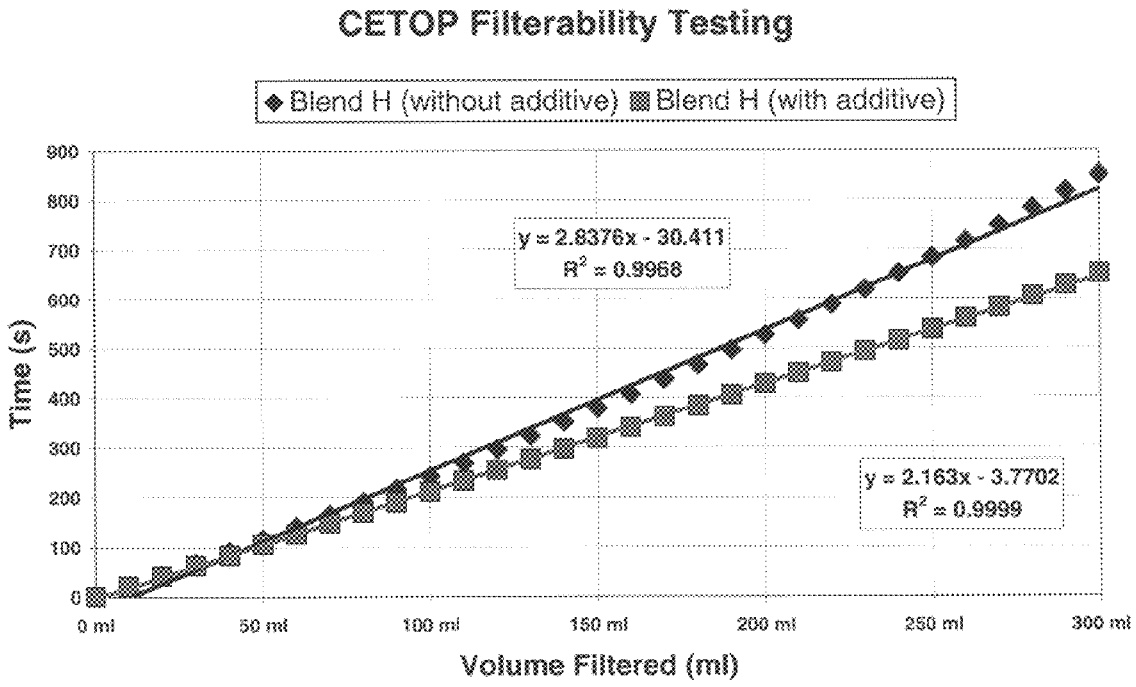
FIG. 6 shows plots of CETOP Filterability test on Blend H.
Figure 7:
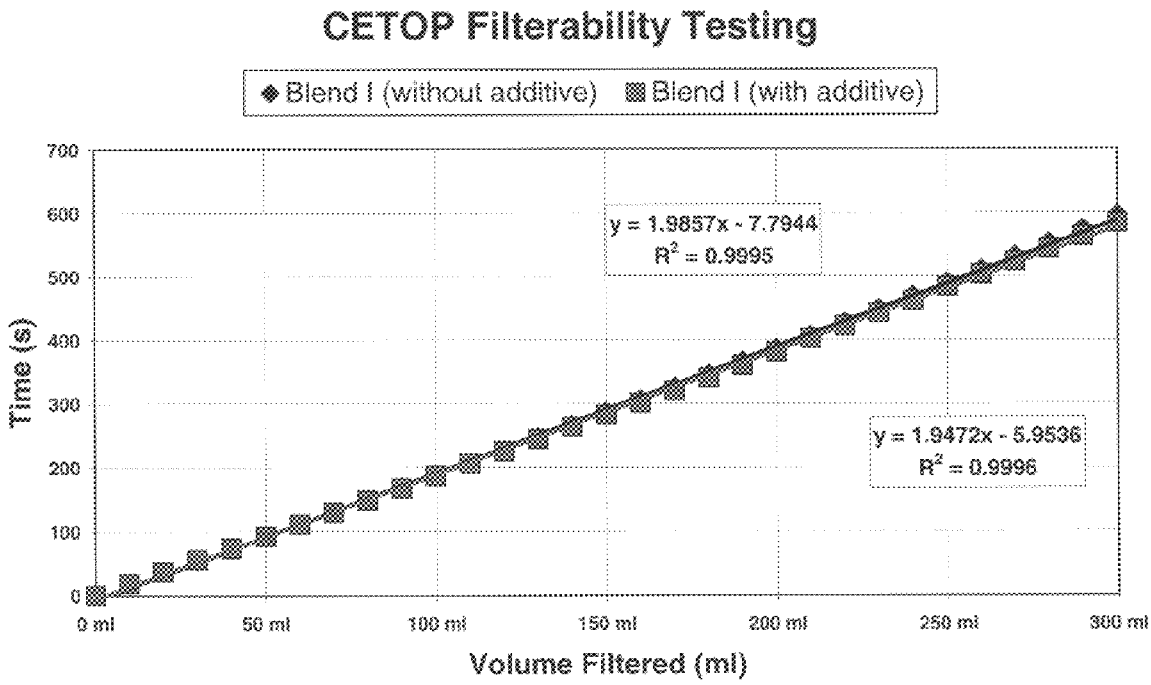
FIG. 7 shows plots of CETOP Filterability test on Blend I.
Figure 8:
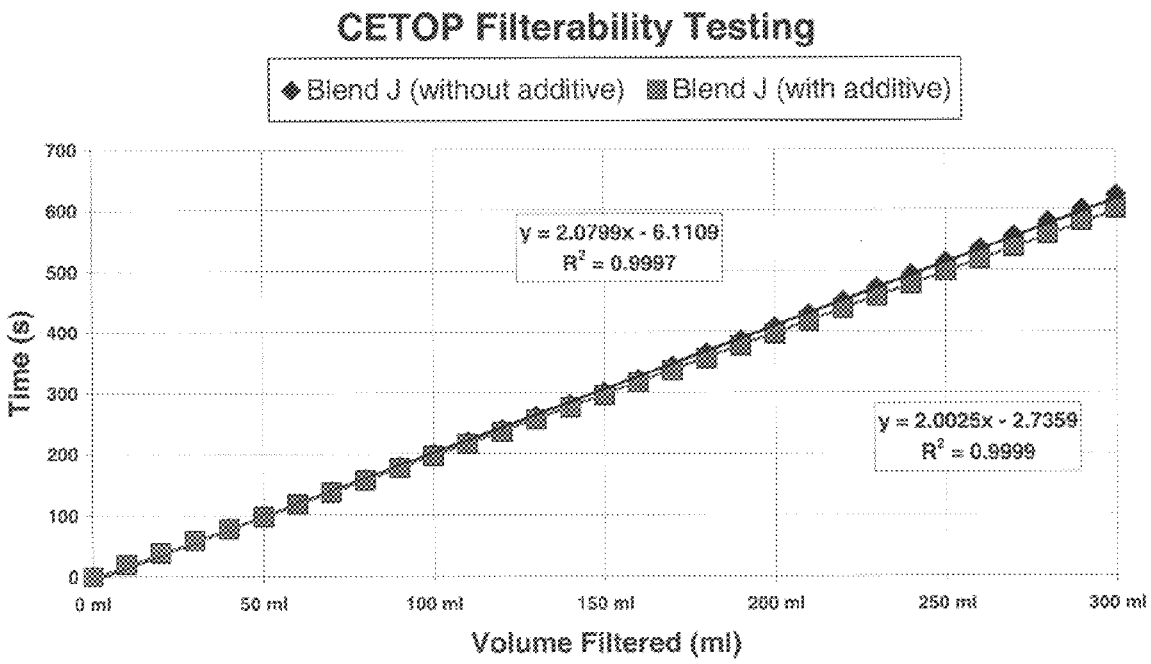
FIG. 8 shows plots of CETOP Filterability test on Blend J.
Figure 9:
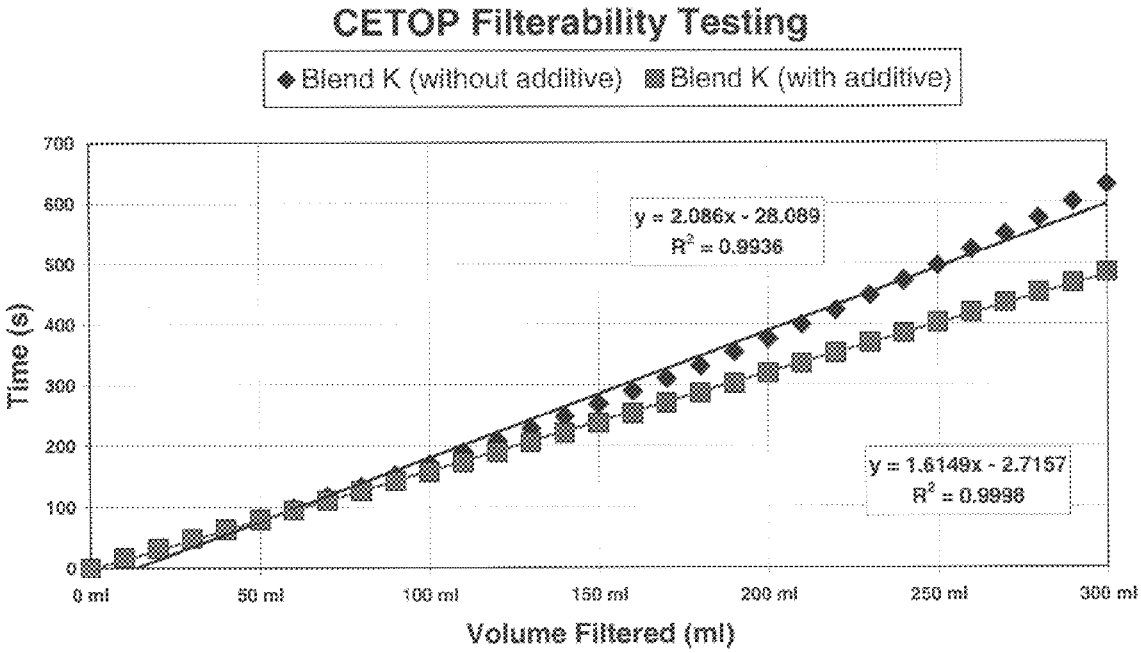
FIG. 9 shows plots of CETOP Filterability test on Blend K.
Figure 10:
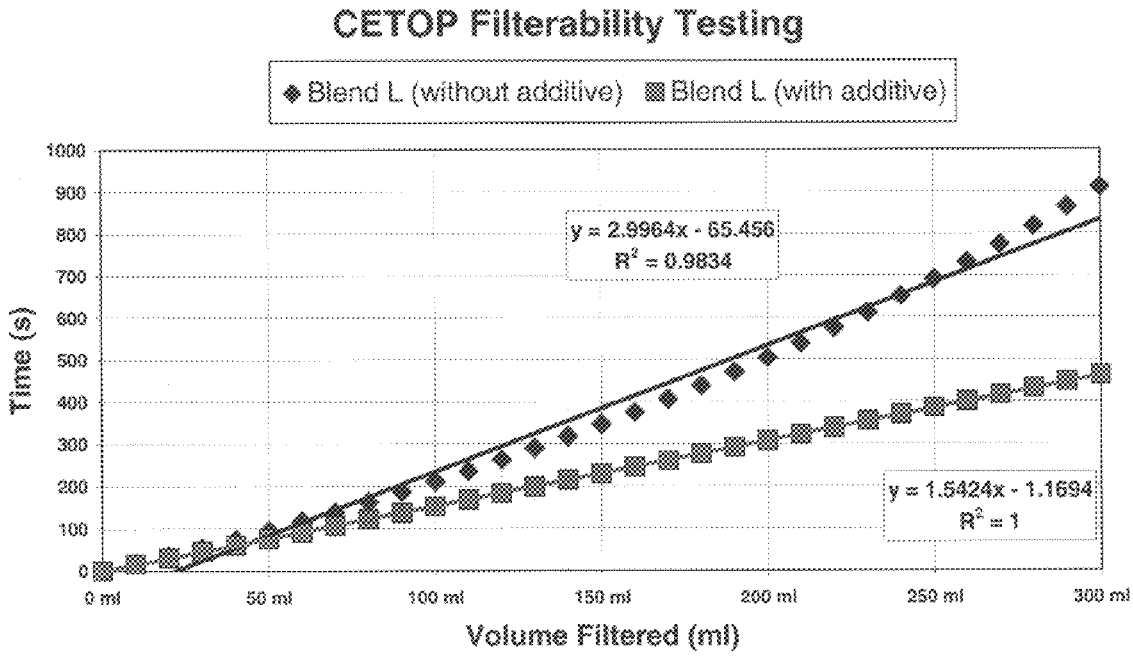
FIG. 10 shows plots of CETOP Filterability test on Blend L.
Figure 11:
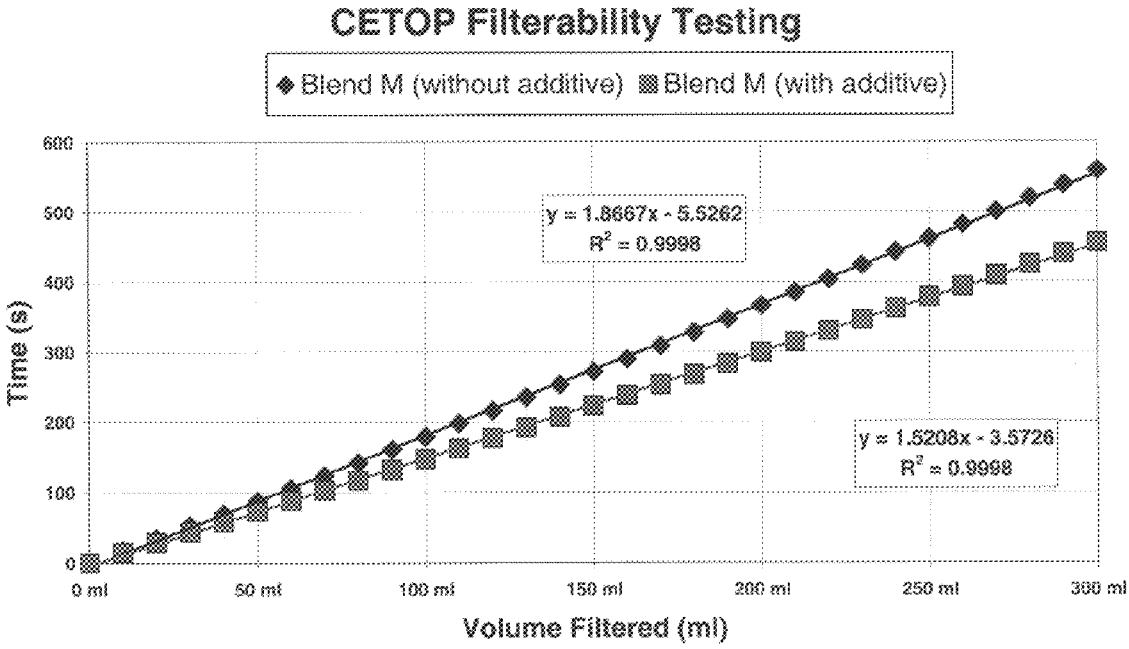
FIG. 11 shows plots of CETOP Filterability test on Blend M.

Plots of Volume Filtered vs. Time values were created as shown in FIGS. 1, 2, 3 and 5. FIG. 1 is an example of a Plot of CETOP Filterability Tests on "blocking" and "non-blocking" blends. FIG. 2 shows plots of Total Basestock Blend, Blend A, Blend B and Blend C. FIG. 3 shows plots of CETOP Filterability Tests on blends D, E and F. FIG. 4 shows the effect of ageing on blends A, B and C and their CETOP Filterability results. FIG. 5 shows results for Blend G.

Using linear regression analysis, $R^2$ values can be obtained ($R^2$=1 is ideal). For example, $R^2$ values for the samples listed in each column of Table 1 are shown in Table 2, below. The time taken to filter 300 ml of each sample was recorded in seconds. CETOP Stage 1 and Stage 2 results were calculated automatically using computer. The $R^2$ values calculated are shown in Table 2.

TABLE 1

Evaluation of Total Brightstock based 85W/140 gear oil.

| Sample (% wt) | Total Brightstock | A* | B** | C*** |
|---|---|---|---|---|
| Total 150 Brightstock | 100.00 | 91.00 | 91.00 | 91.00 |
| A2000 | | 8.50 | 8.50 | 8.50 |
| Plexol 156 | | 0.50 | 0.50 | 0.50 |
| Additive of the present invention | | | 200 ppm | 400 ppm |

*Blend A is 91% Total 150 Brightstock available from Total, 8.5% Anglamol 2000 available at The Lubrizol Corporation, and 0.5% Plexol 156, without additive of the present invention.
**Blend B is the same as Blend A, plus 200 ppm of the additive of the present invention.
***Blend C is the same as Blend A, plus 400 ppm of the additive of the present invention.

Table 1 lists 4 blends that were evaluated. The four blends are Total Brightstock, Blend A, Blend B and Blend C. Column 1 indicates the components in each of these blends, respectively.

Each sample in Table 1 was reheated to 70° C. for 4 hours, removed from the oven and allowed to cool to ambient temperature overnight before testing the next day. The test results are shown in Table 2, below.

TABLE 2

CETOP Filterability Results - 1st Pass (A1NF)

| Result Age | Total Brightstock 1 day | A 3 days | B 2 days | C 1 day |
|---|---|---|---|---|
| CETOP Stage 1 | BLOCKED | BLOCKED | 91.56% | 96.75% |
| CETOP Stage 2 | BLOCKED | BLOCKED | 82.47% | 91.25% |
| Linearity ($R^2$) | BLOCKED | BLOCKED | 0.9990 | 0.9997 |
| Time/Vol @ Termination | $T_{90}$ = 8,393 s | $T_{50}$ = 6,191 s | $T_{300}$ = 4,556 s | $T_{300}$ = 3,588 s |

$T_{90}$ indicates the time taken to filter 90 ml
$T_{50}$ indicates the time taken to filter 50 ml
$T_{300}$ indicates the time taken to filter 300 ml The results for Blends B and C in Table 2 show the benefit of using the additive of the present invention in blends. That is, a $R^2$ value greater than 0.9996 was achieved by Blend C. For Blend B, containing 200 ppm of the additive of the present invention, the improvement is notable, yet it does not meet the CETOP Stage 2 performance requirement of 90% minimum. At 400 ppm (Blend C), however, the required performance is obtained.

More extensive work was carried out on the blends listed in Table 1, as shown in FIG. 4, to examine the effect on filterability results of sample ageing. The main finding was that CETOP filterability performance deteriorated on standing at ambient temperatures over a period of time. However, none of the tests carried out on the fluids containing the filterability additive of the present invention produced a BLOCKED result (as experienced for the all non-treated blends) for any test up to 4 months after the initial test was carried out.

This confirms the effectiveness, both short-term and long-tern, of the filterability additive of the present invention. It is useful as a top-treat where filterability performance is required.

EXAMPLE 2

Evaluation of Total Brightstock/Total 150N-based Fully Formulated Gear Oil with/without Filterability Additive Blend tests were carried out to develop an 85W/140 GO formulation for Total Brightstock to meet the following specification:

| Test | Specification |
|---|---|
| KV100° C. | 5.00 cSt MAX to 24.00 cSt MIN |
| CETOP Filterability Stage 2 90% MIN | |

CETOP testing was carried out on the blends shown in Table 3 to evaluate filterability. FIG. 3 shows the results of this testing. Initial evaluations found Blend D to meet the target viscosity.

To confirm that the additive of the present invention gave long term benefit and that ageing effects did not cause significant difficulties, the blends were allowed to stand for 1 week after heat treatment, (as opposed to 1 day) before testing. The additive-treated blend was tested at 7 and 11 days. The formulations tested are shown in Table 3, below. The results are shown in Table 4.

It is noted that Blend E is the same as Blend F, but that Blend F was tested 4 days later in Table 4 to show the effectiveness of the additive of the present invention with ageing.

TABLE 3

| Formulation/Results | | | |
|---|---|---|---|
| Sample | D | E | F |
| TOTAL BS* | 85.00 | 85.00 | 85.00 |
| TOTAL 150N** | 6.00 | 6.00 | 6.00 |
| Anglamol 2000 | 8.50 | 8.50 | 8.50 |
| Plexol 156 | 0.50 | 0.50 | 0.50 |
| Additive of present invention | — | 400 ppm | 400 ppm |
| KV100° C. | 25.06 cSt | N/A | N/A |

*Total BS is Total Brightstock, ex. Total
**Total 150N is Neutral ex. Total

TABLE 4

| CETOP Results | | | |
|---|---|---|---|
| Sample<br>Days since HT | D<br>7 days | E<br>7 days | F<br>11 days |
| CETOP Stage 1 | 64.01% | 95.25% | 82.11% |
| CETOP Stage 2 | 20.22% | 89.46% | 63.74% |
| Linearity ($R^2$) | 0.9258 | 0.9996 | 0.9941 |
| Time/Vol @ Termination | $T_{300}$ = 9,947 s | $T_{300}$ = 2,328 s | $T_{300}$ = 2,926 s |

The results in Table 4 show the benefit of the addition of the filterability additive of the present invention. The untreated formulation (Blend D) shows unacceptable blockage after 7 days, while the treated blend (Blend E) shows significant improvement after 7 days.

Although performance has deteriorated slightly with aging (11 days, Blend F), the positive effect compared to the non-treated blend remains significant. This aging effect may be due to a wax particle agglomeration on standing.

EXAMPLE 3

Confirmation of CETOP Filterability Performance for Additive of Present Invention A 1 Kg sample of a blend containing Total Brightstock/150N-based fully formulated 85W/140 Grade Gear Oil and 400 ppm of the additive of the present invention was prepared for evaluation using the GFC test, a standard oxidation test used in the industry, especially for transmission fluids. This blend was checked for acceptable CETOP Filterability performance. It is referred to as Blend G. The results are shown in FIG. 5.

The "Run" in FIG. 5 refers to the test conditions and the order of testing. "As rec'd" means the CETOP filterability of the blend as received after blending, (approximately 1 week old), using a standard millipore 5 $\mu$m membrane. Both runs used a new filter membrane.

The "As rec'd" test obtained a "blocked" result. This may be because the blend was not heated high enough in blending to disperse the wax present in the Brightstock.

However, the HT test achieved excellent results. The "HT" stands for "Heat Treated." This is a procedure whereby a blend to be evaluated is reheated to 70° C. and allowed to cool for 16 to 24 hours before testing so that any "thermal history" is removed. This "thermal history" is an ageing effect due to wax particles (inherent in the Brightstock mineral oils used to make gear oil blends), that have crystallised out (even at parts-per-million levels (ppm)), and could therefore cause filter blockage. Blends are heat treated to get them back to square one, then, as a blend ages, a comparison of treated blends versus non-treated blends can be made.

For Example 3, the HT sample was heated in an oven at 80° C., then taken out and allowed to cool to ambient temperature (approx. 20° C.) overnight before being retested using a new filter. The results for the HT sample were excellent, as shown in FIG. 5.

Testing has established that for a "non-blocking" blend, the time taken to filter a sample (EOT T300 ml values were used) is proportional to the viscosity of the blend. PAO blends of known viscosities (using the Bohlin rheometer at 20° C.) and T300 ml were evaluated and the relationship between Dynamic Viscosity (DV20° C.) and T300 ml was determined. From this, the T300 ml for any non-blocking sample that has a known DV20° C. can be predicted.

The rheometer found Blend G to have a Dynamic Viscosity of 1.314 Pas at 20° C. The predicted T300 ml value for this viscosity was calculated as 2,166 seconds. The actual T300 ml value was 2,104 seconds. This confirms that the CETOP test result on Blend G is valid, (i.e., filter membrane is the appropriate grade, it was not torn or damaged during the test).

Also, the linearity results in FIG. 5, for the HT test, showed zero filter blockage occurred, (1.0000 is ideal).

Also, the linearity results in FIG. 5, for the HT test, showed zero filter blockage occurred (1.0000 is ideal).

FIGS. 6, 7, 8, 9, 10 and 11 are plots of Volume filtered vs Time values for the 6 Ready Blends that were evaluated, available at Castrol, referred to as ex. Castrol blends. Each of these figures compares an ex. Castrol blend having the additive of the present invention in an amount of 400 ppm with the same ex. Castrol blend without the additive of the present invention. These blends are Blends H, I, J, K, L and M are shown in FIGS. 6, 7, 8, 9 and 11, respectively. Using linear regression analysis, the $R^2$ was obtained, and is indicated in each of the figures and also indicated below in Table 5.

TABLE 5

| Ex. Castrol Blend | $R^2$ Value (without additive) | $R^2$ Value (with additive, 400 ppm) |
|---|---|---|
| H | 0.9968 | 0.9999 |
| I | 0.9995 | 0.9996 |
| J | 0.9997 | 0.9999 |
| K | 0.9936 | 0.9998 |
| L | 0.9834 | 1.0000 |
| M | 0.9998 | 0.9998 |

Table 5 shows that the improved filterability of ex. Castrol blends H, I, J, K and M was achieved by top-treating each blend with 400 ppm of the additive of the present invention. None of the top-treated blends show a detrimental effect in filterability with the addition of the additive of the present invention.

FIG. 12 illustrates the CETOP filterability data, along with CETOP Stage 1, and CETOP Stage 2 results, for each ex. Castrol blend H, I, J, K, L and M with (400 ppm) and without the additive of the present invention.

As indicated earlier, for a blend to have acceptable filterability performance, a blend must have a CETOP Stage 2 result of equal to or greater than 90%. FIG. 12 shows that ex. Castrol Blends H, J, K, L and M, when top-treated at 400 ppm with the additive of the present invention, achieved CETOP Stage 2 results of greater than 90%. FIG. 12 also shows that the nontreated ex. Castrol Blends H, K and L are classified as a "FAIL" (CETOP Stage 2 results of less than 90%), whereas their top-treated counterparts are classified as a "PASS" (CETOP Stage 2 results of a minimum 90%).

It should be understood that the forms of the invention described herein are exemplary only and are not intended as limitations on the scope of the present invention.

What is claimed is:

1. A filterability improver for mineral oil distillates and heavy base oils containing wax material consting essentially of a blend containing from about 30% to about 70% of an alkyl ester polymer and from about 70% to about 30% naphthenic oil, based upon the total weight of said blend, wherein such filterability improver prevents filter blockage due to wax formation at ambient temperatures.

2. The filterability improver of claim 1 wherein the blend contains 50% of an alkyl ester polymer and 50% of naphthenic oil based on the total weight of the blend.

3. The filterability improver of claim 1 wherein the alkyl ester polymer is selected from the group consisting of ethylene-vinyl proprionate copolymers, ethylene-vinyl butyurate copolymers, $C_2$–$C_{12}$ olefin-vinyl-acetate copolymers, ethylene-$C_4$ olefin-vinyl acetate tertpolymers, ethylene-vinyl acetate-vinyl ether tertpolymers, ethylene-propylene vinyl acetate tertpolymers, ethylene-diene-vinyl acetate tertpolymers, and combinations thereof.

4. The filterability improver of claim 1 wherein the alkyl ester polymer is an ethylene-vinyl acetate.

5. The filterability improver of claim 4 wherein the ethylene-vinyl acetate polymer has a ratio of ethylene to vinyl acetate of 64.9:35.1 to about 83.2:16.8 in moles % ethylene:vinyl acetate.

6. The filterability improver of claim 1 wherein the molecular weight of the polymer is from about 2,000 to 10,000.

7. The filterability improver of claim 1 wherein the molecular weight of the polymer is from about 3,000 to 4,000.

8. The filterability improver of claim 1 wherein the polymers have a branching index from about 4 to about 10.

9. The filterability improver of claim 1 wherein the polymers have a branching index from about 8 to about 9.

10. The filterability improver of claim 1 that is used as an additive for high viscosity mineral oils, mineral oil-based blends, manual transmission oils, axel factory fill oils, gear oils, hydraulic oils, semi-fluid grease formulations, Brightstock-based gear oils, extended drain oils and combinations thereof.

11. A process to improve the filterability of industrial fluids comprising adding a filterability improver consisting essentially of a blend or about 30% to about 70% of an alkyl ester polymer and from about to 70% to about 30% naphthenic oil to a filtration system to prevent.

12. The process of claim 11 wherein the fluid is selected from the group consisting of high viscosity mineral oils, mineral oil-based blends gear oils, hydraulic oils, semi-fluid grease formulation, manual transmission oils, axle factory fill oils, extended drain oils, Brightstock-based gear oil and combinations thereof.

13. The process of claim 11 wherein the filterability improver is added to the filtration system in the range of about 10 ppm to about 1,000 ppm based upon the total weight of the fluid plus filterability improver.

14. The process of claim 11 wherein the filterability improver is added to the filtration system at from about 250 ppm to 650 ppm based upon the total weight of the fluid plus filterability improver.

15. The process of claim 11 wherein the filterability improver is added to the filtration system at from about 440 ppm based upon the total weight of the fluid plus filterability improver.

16. The process of claim 11 wherein the filtration system comprises a filter membrane of around 5 $\mu$m.

17. A filterability improver for mineral oil distillates and heavy base oils containing wax material comprising a blend containing from about 30% to about 70% of an alkyl ester polymer and from about 70% to about 30% naphthenic oil, based upon the total weight of said blend, wherein such filterability improver prevents filter blockage due to wax formation at ambient temperatures.

* * * * *